United States Patent [19]

Dulger et al.

[11] 4,235,130

[45] Nov. 25, 1980

[54] ADJUSTABLE STROKE PISTON AND CRANKSHAFT ASSEMBLY

[75] Inventors: Viktor Dulger, Ludolf-Krehl-Strasse 8, 6900 Heidelberg, Fed. Rep. of Germany; Franz Ernst, Heidelberg, Fed. Rep. of Germany

[73] Assignee: Viktor Dulger, Heidelberg, Fed. Rep. of Germany

[21] Appl. No.: 938,348

[22] Filed: Aug. 31, 1978

[30] Foreign Application Priority Data

Sep. 10, 1977 [DE] Fed. Rep. of Germany ..... 2740913

[51] Int. Cl.[2] ..... F16H 21/32

[52] U.S. Cl. ..... 74/831; 74/44; 74/834

[58] Field of Search ..... 74/829, 831, 834, 44; 92/13.4, 13.5, 13.7

[56] References Cited

U.S. PATENT DOCUMENTS

| | | | |
|---|---|---|---|
| 905,823 | 12/1908 | Montgomery | 92/13.7 X |
| 2,259,713 | 10/1941 | Valentine | 92/13.7 X |
| 2,615,398 | 10/1952 | Howard | 74/834 |
| 2,830,455 | 4/1958 | Harmon | 92/13.7 X |
| 2,841,991 | 7/1958 | Saalfrank | 92/13.7 X |
| 2,953,029 | 9/1960 | Caillaud | 92/13.7 X |

FOREIGN PATENT DOCUMENTS

| | | | |
|---|---|---|---|
| 187870 | 12/1956 | Austria | 92/13.7 |
| 1027307 | 2/1953 | France | 92/13.7 |

*Primary Examiner*—Robert Mackey
*Attorney, Agent, or Firm*—Wayne B. Easton

[57] ABSTRACT

The invention relates to an adjustable stroke piston machine assembly wherein the stroke is adjustable steplessly from zero to full displacement. Two connecting rods are provided and a pivotal joint between the rods is guided by an arc shape path of a guide member. The guide member is pivotally adjustable to vary the position of the arc shaped path relative to the piston and thereby vary the stroke of the piston.

3 Claims, 4 Drawing Figures

ADJUSTABLE STROKE PISTON AND CRANKSHAFT ASSEMBLY

Figure 1:
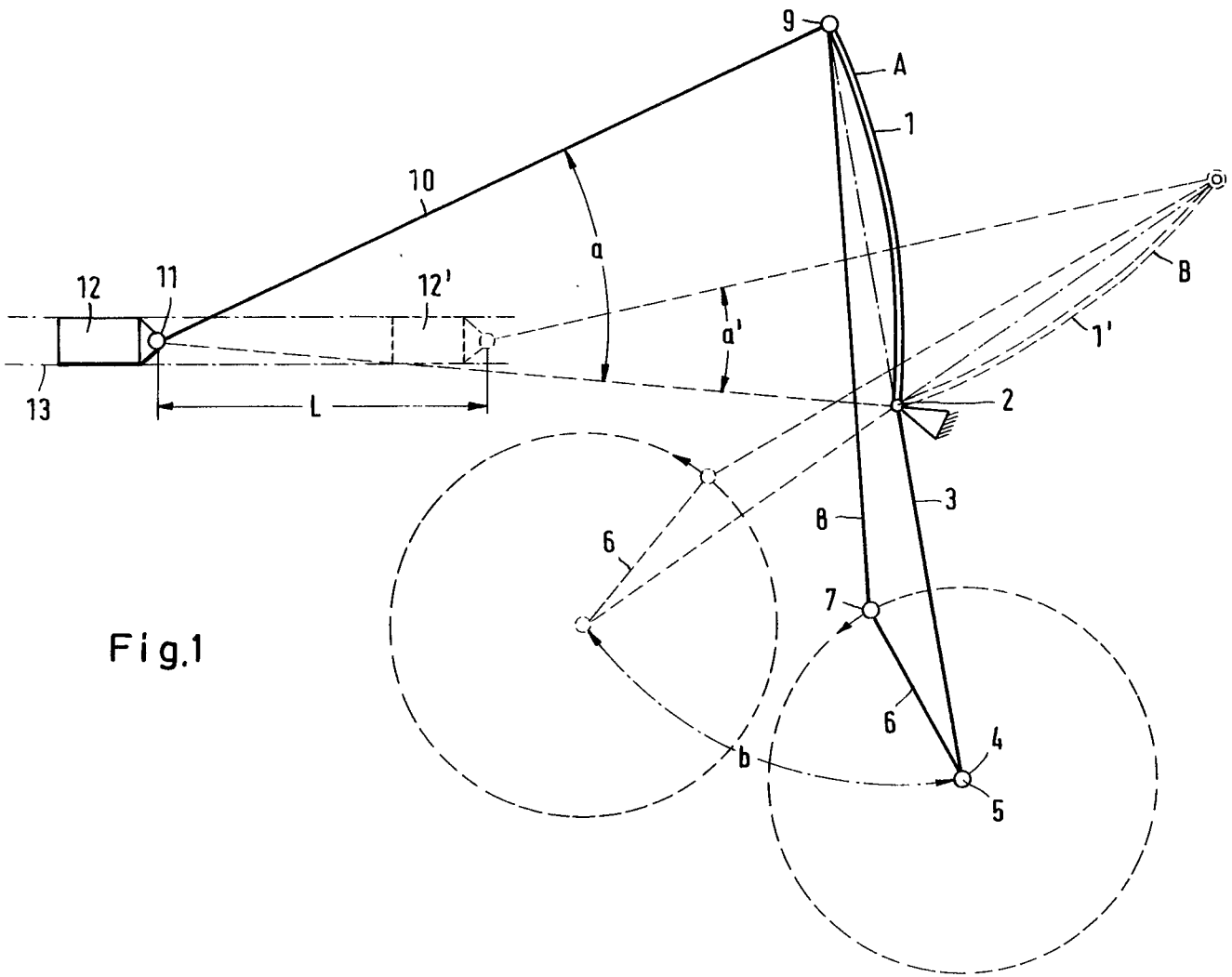

The invention relates to a pump arrangement, comprising a piston pump, the thrust piston of which can be driven by means of a motor-driven crankshaft, a connecting rod and a push rod which is connected via a first joint to the connecting rod and via a second joint to the piston, the first joint being guided on a circular path which is displaceable by means of an adjustment device and the center point of which lies, on one setting, on the path of the second joint.

Pump arrangements of this type are known. With these, variable delivery rates can be dispensed. In particular, they can be used as metering pumps.

In a known pump arrangement, the crankshaft is in a fixed mounting in the casing. With the aid of the adjustment device, the pivot point for a lever is varied, which lever guides the first joint on a circular arc which, depending on the setting, has a different length. To obtain a zero stroke, the lever must have the same length as the push rod and the pivot point must be arranged on the same axis as the second joint. This has the consequence that the piston must protrude from the cylinder, that is to say it must be relatively long. Furthermore, difficulties arise if a long push rod is to be used in limited space or if a wide control range is to be achieved.

It is the object of the invention to indicate a pump arrangement of the type initially described, which can be infinitely regulated down to the delivery rate of zero and in which the design layout is not impeded by a lever guiding the first joint.

According to the invention, this object is achieved when the circular path is formed by a slotted link which is pivotable about a pivot axis, fixed in the casing, and has the form of a segment of a circle, the radius of which is equal to the length of the push rod, and when the bearing for the crankshaft is rigidly joined to the slotted link.

In this design, the stroke of the piston can be varied by pivoting the slotted link. The length of the push rod can be taken into account by the choice of radius of the slotted link. It is possible to provide a short piston, in the case of which the second joint is located within the cylinder, when in the zero position. Since the bearing for the crankshaft is also pivoted with the slotted link, the same conditions result for any setting of the connecting rod and its guide in the slotted link. In particular, the circular arc described remains constant and, with given dimensions of the push rod and connecting rod, this has an advantageous effect on the space requirement.

It is advantageous when the pivot axis, fixed in the casing, is located at one end of the slotted link and the center point of the circle in one pivoting position coincides with the position of the second joint at top dead center during the maximum stroke. This has the consequence that the dead center remains the same in the entire regulating range and the storke is varied merely by changing the bottom dead center. The clearance volume of the pump therefore remains always the same and can be kept relatively small.

In a preferred embodiment, the bearing for the crankshaft is located on a straight line, which approximately connects the two end points of the slotted link, on that side of the pivot axis, fixed in the casing, which is opposite to the slotted link. In this way, the greatest possible maximum piston stroke is achieved for a given diameter of the crank path. The more the slotted link is pivoted in the direction of an increasing piston stroke, the more the force component of the connecting rod for the pump stroke approaches the corresponding force component of the push rod.

The crankshaft can be driven directly by a motor which, however, would then have to be pivotable with the slotted link. It is therefore more advantageous when the crankshaft carries a first gear which meshes with a second gear rotatable about the pivot axis, fixed in the casing. In this way, it is possible to use a motor in a fixed position, which drives the second gear.

There is the further possibility of joining the second gear, secure against rotation, to a larger third gear which meshes with a pinion borne on a drive shaft in a fixed mounting in the casing. In this case, the pinion and the third gear form and reduction gearing which makes it possible to use a high-speed drive motor.

Advantageously, the adjustment device comprises a worm-wheel quadrant connected to the slotted link, and a worm, the shaft of which is provided with an actuating element and extends perpendicular to the pivot axis, fixed in the casing. The worm locks the slotted link in the selected pivoting position, even though the actuating element can also be locked in addition. Since the shaft of the adjustment device and the piston axis extend perpendicular to the pivot axis, fixed in the casing, it is readily possible to arrange the individual outer functional elements in such a way that they do not hinder one another.

A particularly efficient arrangement results when the drive shaft, pinion, gears, crankshaft, slotted link, connecting rod and push rod are accommodated in one casing and the drive shaft is borne in the two side walls thereof, the first side wall comprising fixing means for connecting the motor, the pump cylinder being located on a third wall and the actuating element for the adjustment device being located on a fourth wall. In this case, three walls are each occupied by one functional element so that certain tasks can still be allocated to three further walls, for example, the task of a bottom surface can be allocated to one wall and the task of an inaccessible rear wall can be allocated to an adjacent wall.

A scale which indicates the percent stroke and the pointer of which is connected to the slotted link, can be located on one of the fourth to sixth walls.

In any case, the second side wall is still available for further functions. Therefore, fixing means for connecting a further casing can be provided on this second side wall, and the drive shaft can project beyond the casing on one side and can carry a coupling member at one end and a mating coupling member, which fits the former, at the other end. The basic design of the pump arrangement thus enables a number of individually controllable pumps to be driven with the aid of a single drive motor.

Constructionally, it is advisable that the slotted link is formed by cut-outs in two jambs which each contain one bearing for the crankshaft and each carry one stub shaft borne in the side walls, that the first joint has a gudgeon, the two ends of which each carry a roller guide in a cut-out, and that the second and third gears are borne on one of the stub shafts. This results in a space-saving mode of running with low friction.

Figure 4:
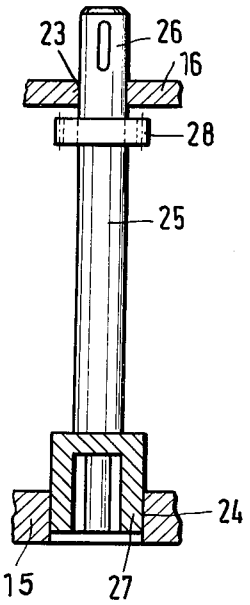
Figure 2:
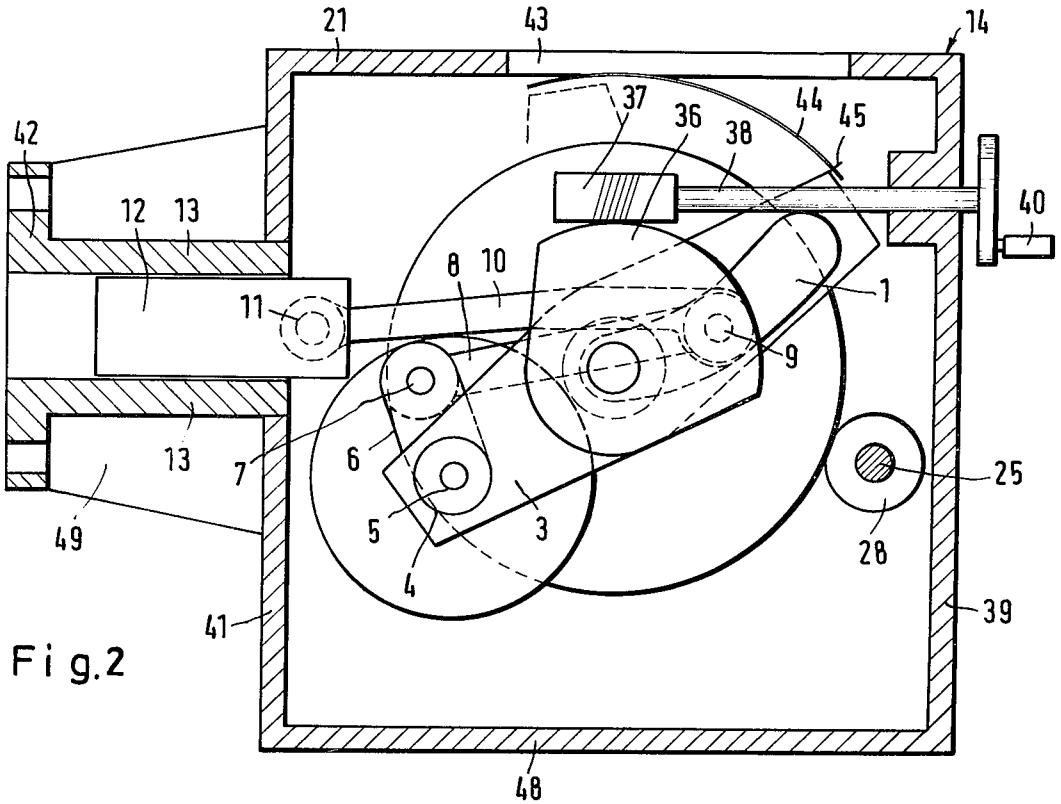
Figure 3:
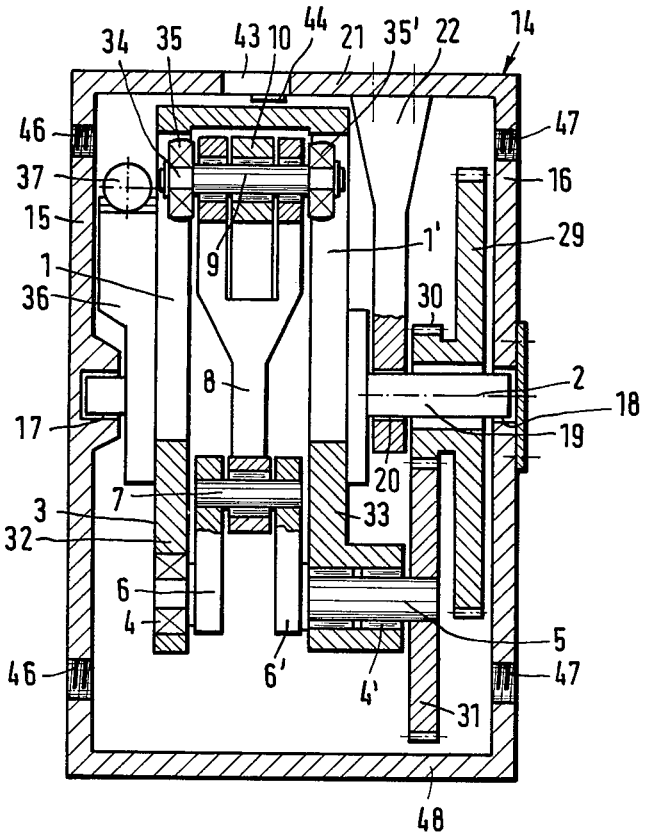

In the following text, the invention is explained in more detail by reference to an illustrative embodiment represented in the drawing in which:

FIG. 1 diagrammatically shows the kinematics of the pump arrangement according to the invention, FIG. 2 shows a section through a casing of the pump arrangement, perpendicular to the pivot axis, fixed in the casing, together with a side view of the inner components, FIG. 3 shows a section going through the pivot axis, fixed in the casing, the slotted link extending approximately parallel to the plane of the drawing, and FIG. 4 shows a plan view of the drive shaft.

It is seen from FIG. 1 that a slotted link 1 is pivotable about a fixed pivot axis 2 at one end point of the slotted link from the fully drawn position A into the position B drawn in broken lines. Via a carrier 3, the slotted link 1 is rigidly joined to a bearing 4 for a crankshaft 5, the crank 6 of which is connected via a joint 7 to a connecting rod 8. The latter is connected via a joint 9 to a push rod 10 which is in turn connected via a joint 11 to a piston 12 of a pump, which piston is axially displaceable in a cylinder 13. The joint 9 is guided in the slotted link 1. The slotted link has the form of a segment of a circle, the radius of which is equal to the length of the push rod and the center point of which coincides, in the position A, with the joint 11, the length of which in this position corresponds to the top dead center of the piston 12.

When the crank 6 rotates in the position A of the slotted link 1, the push rod 10 merely carries out a pivoting motion by the angle a. A storke does not take place in this case. If the slotted link 1 is pivoted by the angle b into the position B drawn in borken lines, the pivoting angle of the push rod 10 is reduced to the value a' whilst, at the same time, the pivoting motion is superposed by an axial motion which moves the piston 12 to and fro between the fully drawn top dead center position and the position 12' in broken lines, that is to say the maximum stroke L. The more the slotted link 1 approaches the position B, the more the direction of the force component transmitted by the connecting rod 8 also approaches the direction of the force component to be transferred by the push rod 10. As a consequence, there is relatively little load on the slotted link.

An embodiment in practice is illustrated in FIGS. 2 to 4. The same reference signs as in FIG. 1 are used here for the corresponding parts.

A casing 14 which in practice is composed of at least two parts, has, in each of the two side walls 15 and 16, one bearing 17 and 18 for a shaft 19 which defines the pivot axis 2, fixed in the casing. This shaft can additionally be supported in a bearing 20 which is formed in a beam 22 fixed to the cover wall 21. Furthermore, bearings 23 and 24 for a drive shaft 25 are provided in the side walls 15 and 16, which drive shaft carries a protruding coupling member 26 at one end and a corresponding mating coupling member 27 at the other end. Moreover, a pinion 28 is fixed to this drive shaft. The pinion drives a gear 29 which is rigidly joined to a gear 30. The two gears are borne on the shaft 19. The gear 30 meshes with a gear 31 which drives the crank shaft 5. The carrier 3 has two jambs 32 and 33 which each have a cut-out 1 and 1' respectively, forming the slotted link 1, and a crankshaft bearing 4 and 4', respectively. The crank also consists of two jambs 6, 6' which between them receive push rod 8. The end of the latter is forked and receives the stroke rod 10 therein. The ends of the gudgeon 34 of the point 9 are provided with rollers 35 and 35' which can roll in the cut-outs 1 and 1', respectively, of the slotted link. A worm-wheel quadrant 36, on which a worm wheel 37 engages, is mounted on the jamb 32. The associated shaft 38 extends through a further wall 39 of the casing and ends in an actuating element 40 which here has the form of a handwheel. On the opposite wall 41, the cylinder 13 of the pump is located, which is reinforced on the outside by ribs 49 and carries on the end face a flange 42 for connecting any desired pump head. Furthermore, a slot 43 is provided in the upper wall 21, and a strip 44 having the form of a cylinder segment and carrying a scale on its upper side is located below the slot. One edge 45 of the carrier 3 is associated with this scale as a pointer. Consequently, the set percent stroke can be read off there.

In the side wall 15, there are threaded holes 46, by means of which a motor can be fixed to this side wall. This motor has an output shaft which can engage with the mating coupling member 27 (FIG. 4). In the opposite side wall 16, there are threaded holes 47 which can serve for mounting a further casing 14 of the same type, wherein the mating coupling member 27 engages with the coupling member 26 of the pump arrangement illustrated. In all cases, the bottom wall 48 is free from any constructional elements so that the arrangement can be put down on this face.

In an illustrative embodiment, the motor had a speed of rotation of 1,470 revolutions per minute. With a reduction of 10 to 1 with the aid of the pinion 28 and the gears 29, 30 and 31, this gave a stroke number of 147 strokes per minute. The diameter of the piston and the maximum stroke L were designed in such a way that, at this stroke number, a maximum delivery rate of 1,000 liters/hour could be supplied under a pressure of 30 bars. This delivery rate could be regulated down continuously to zero.

What we claim is:

1. An adjustable stroke piston and crankshaft assembly, comprising, a housing, a piston, a path for said piston having top and bottom dead center positions TDC and BDC, a first connecting rod pivotally connected to said piston, a fixed bearing in said housing at a distance from said TDC position equal to the length of said connecting rod, a guide memeber pivotally connected to said fixed bearing, said guide member having an arc shaped guide path formed on one side of said fixed bearing and a lever arm extending from the other side of said fixed bearing, a crank arm rotatably connected to said lever arm, a second connecting rod having a first pivotal connection with said crank arm and a second pivotal connection with said first connecting rod, said second pivotal connection being confined to movment along said arc shaped guide path, said guide member having an idle position wherein said arc shaped guide path has its center coincident with said TDC position and running positions wherein points of said guide path are at distances from said TDC position which are greater than the length of said first connecting rod, and means for adjustably pivoting said guide member relative to said fixed bearing to vary the displacement stroke of said piston.

2. An assembly according to claim 1, a worm gear segment attached to said guide member, a worm gear rotatably mounted relative to said housing and engaging said segment, and means for rotating said worm gear to adjust the position of said guide member.

3. An assembly according to clam 1, shaft means connecting said crank arm to said lever arm, a planetary gear connected to said shaft means, a sun gear effectively journaled in said fixed bearing and engaging said planetary gear to effect rotation of said crank arm, and means for rotatingly driving said sun gear.

* * * * *